US005497527A

United States Patent [19]

Jang et al.

[11] Patent Number: 5,497,527

[45] Date of Patent: Mar. 12, 1996

[54] PAINT ROLLER HANDLE

[76] Inventors: Bor-Zeng B. Jang, 2076 S. Evergreen Dr., Auburn, Ala. 36830; Don W. Parker, Rte. 4 Box 37, Enterprise, Ala. 36330

[21] Appl. No.: 230,973

[22] Filed: Apr. 21, 1994

[51] Int. Cl.[6] ..... B05C 17/02

[52] U.S. Cl. ..... 15/230.11; 15/143.1; 15/144.1; 15/145; 15/248.2; 492/13; D4/122

[58] Field of Search ..... 15/143.1, 144.1, 15/144.2, 144.3, 144.4, 145, 146, 230.11, 248.2; 492/13; D4/122, 123, 138

[56] References Cited

U.S. PATENT DOCUMENTS

| | | | |
|---|---|---|---|
| 2,904,813 | 9/1959 | Schleicher | 15/145 |
| 3,044,094 | 7/1962 | Ecker | 15/230.11 |
| 3,357,035 | 12/1967 | Ficke | 15/144.1 |
| 3,737,187 | 6/1973 | Pryor | 15/144.1 |
| 3,825,970 | 7/1974 | Hanssen | 15/230.11 |
| 4,089,082 | 5/1978 | McGrew | 15/144.1 |
| 4,196,491 | 4/1980 | Baril | 15/144.4 |
| 4,254,529 | 3/1981 | Cooke | 15/230.11 |
| 4,263,690 | 4/1981 | Dobosi | 15/230.11 |
| 4,528,714 | 7/1985 | Beck | 15/144.1 |
| 5,167,055 | 12/1992 | Stoddart et al. . | |
| 5,207,755 | 5/1993 | Ampian | 15/230.11 |
| 5,261,142 | 11/1993 | Linn et al. | 15/145 |

FOREIGN PATENT DOCUMENTS

| | | | |
|---|---|---|---|
| 981406 | 3/1973 | Canada | 15/230.11 |
| 3278 | of 1886 | United Kingdom | 15/145 |

*Primary Examiner*—Mark Spisich
*Attorney, Agent, or Firm*—Veal & Marsh

[57] ABSTRACT

A handle for a paint roller that can be used to paint horizontally (left and right, or 90-degree direction), vertically (up and down, or 0-degree direction), or any angle between 0 and 90 degrees by simply adjusting the roller handle-shaft configuration; said configuration possessing one of the following features: (1) having at least one transverse hole, making an angle of approximately 90 degrees or less with the handle length, which can accommodate a telescopic rod; (2) comprising two detachable handle segments wherein one segment has at least one transverse hole to accommodate one end of the second handle segment or a telescopic rod; (3) comprising at least a wire coil, female thread, near one end of the shaft, that constitutes a transverse hole to accommodate the male thread of a handle or a telescopic rod to facilitate horizontal paint rolling. In each case, the opposite end of the handle could optionally have one vertical hole to accommodate a telescopic rod.

5 Claims, 5 Drawing Sheets

PAINT ROLLER HANDLE

FIELD OF INVENTION

The present invention relates to a paint roller handle whose configuration can be readily adjusted to facilitate horizontal, vertical, or other directional painting motions.

RELATED ART STATEMENT

There are currently two broad categories of paint-applying rollers: shielded and unshielded. A commonly used unshielded roller has a frame that is made up of a roller cage assembly and a shaft, usually a properly bent metallic rod with one end connected to or partially embedded in a plastic or wood-based handle. Examples can be found in U.S. Pat. No. 5,167,055 and the patent documents cited therein. The shielded paint-applying roller apparatus, as exemplified in U.S. Pat. No. 3,825,970, protects the user from spattering paint while painting. U.S. Pat. No. 4,254,529 provides an improved shielded paint roller that when placed in an inverted position has a shield that will catch any paint dripping from the paint roller.

These prior-art rollers can be used to effectively apply paint in a vertical (up and down) direction. However, some painting tasks can be best accomplished by painting in the horizontal (left and right) direction. Examples include when a telescopic or extension rod is connected to a roller for painting a high location such as a facia, where horizontal rolling is more convenient to perform and provides better painting quality than vertical rolling. When roll painting up and down on an upper wall location near the edge of a ceiling, one tends to accidentally paint on the ceiling surface. This undesirable result can be more effectively avoided by rolling the paint applicator horizontally. In these situations, prior-art rollers cannot be used because the paint roller handle system, including the handle plus the connected extension rod, will form a substantially straight-line configuration for up-and-down rolling only. The roller handle must be in a horizontal orientation with the extension rod in the vertical orientation in order for the roller to roll horizontally when the extension rod is moved horizontally.

U.S. Pat. 5,261,142 discloses a paint roller frame having a wire coil female thread for attaching a handle or an extension rod thereto. The wire coil female thread is formed directly in the wire frame that is used to support the roller. The wire coil female threads lock into the rigid male threads of a handle to prevent accidental loosening. Again, the wire coil design as specified in this referenced patent would not permit convenient execution of horizontal rolling on overhead surfaces.

OBJECTS AND SUMMARY OF THE INVENTION

It is an object of the present invention to provide a paint-applying roller handle that has a provision for transverse connection to a telescopic rod to facilitate horizontal rolling.

It is another object of the present invention to provide a paint-applying roller handle with a configuration that can be easily adjusted to change the rolling direction.

It is yet another object of the present invention to provide a paint-applying roller handle that can be adjusted to change the rolling direction and can be easily connected to a telescopic rod to facilitate horizontal painting on a high location.

One embodiment of the present invention contains a paint roller handle that has a threaded or un-threaded hole being approximately transverse to the handle length direction. The handle could also have another threaded or un-threaded hole (the vertical or end hole) at one end. Both holes may be female threaded to accommodate a male threaded end of a telescopic rod. Alternatively, both holes may be plain or un-threaded to accommodate a slightly tapered end of an extension rod. The extension rod, once fitted into the transverse hole of the handle, will allow the user to easily roll the roller horizontally. When connected to the end hole of the handle, as in the case of prior-art rollers, the extension rod will allow the user to move the roller vertically.

A second embodiment of the present invention contains a two-segment paint roller handle that has at least one transverse hole and one vertical hole in the first segment and possibly another vertical hole at the end of the second segment. The first segment is the portion of the handle that is integral with, or connected to, the shaft of the paint roller frame. The two holes of the first handle segment could be female threaded to alternately accommodate a male threaded end of the second handle segment. Alternatively, both holes in the first segment could be plain or un-threaded to accommodate a slightly tapered end of an extension rod. Both designs would allow for easily and readily swapping between two handle configurations for vertical rolling and horizontal rolling, respectively. The other end of the second handle segment could contain a hole, threaded or un-threaded, to receive an extension rod.

A simple variation of this second embodiment of the present invention is to have a paint roller configuration, wherein the portion of the shaft that is connected to the handle is regarded as the first segment of the handle. This portion of the shaft (e.g., a metallic rod or plastic tube) can be inserted into a vertical hole at the top end of the handle or, alternately, a transverse hole of the handle and be tightened or firmly gripped in position by using at least one screw or bolt, or other fastening means.

Another simple variation of this second embodiment is to have, at the end of a wire shaft considered as the first handle segment, at least a wire coil female thread forming a transverse hole to accommodate either a handle (or second segment of a handle) or a telescopic rod to facilitate horizontal paint rolling on high overhead surfaces. This wire coil female thread may be either formed directly in the wire frame or be connected to the roller frame shaft by any joining or fastening means. This transverse coil thread may be further connected to a vertical coil female thread to permit vertical rolling as well as horizontal rolling.

A third embodiment of the present invention contains a paint roller handle wherein the two segments of the presently invented handle are connected through at least one pivot or other fastening means. Such a mechanism permits the two handle segments to alternate between a substantially line-up configuration and a mutually perpendicular configuration, or any angle in between these two extremes. These two preferred handle configurations allow for vertical and horizontal rolling, respectively. Again, the opposite end of the second handle segment could have a hole to receive an extension rod. A simple variation of this third embodiment of the present invention is to have a paint roller configuration, wherein the portion of the shaft that is connected to the handle is regarded as the first segment of the handle. This portion of the shaft, e.g., a metallic rod or plastic tube that is intentionally made to be slightly wider or somewhat flat in geometry at one end, can be joined with the top end of the handle (the second segment) by at least one pivot or other fastening means. In this alternative configuration, the shaft can be made to rotate with respect to the second segment of the handle to change the paint rolling direction.

Figure 1:
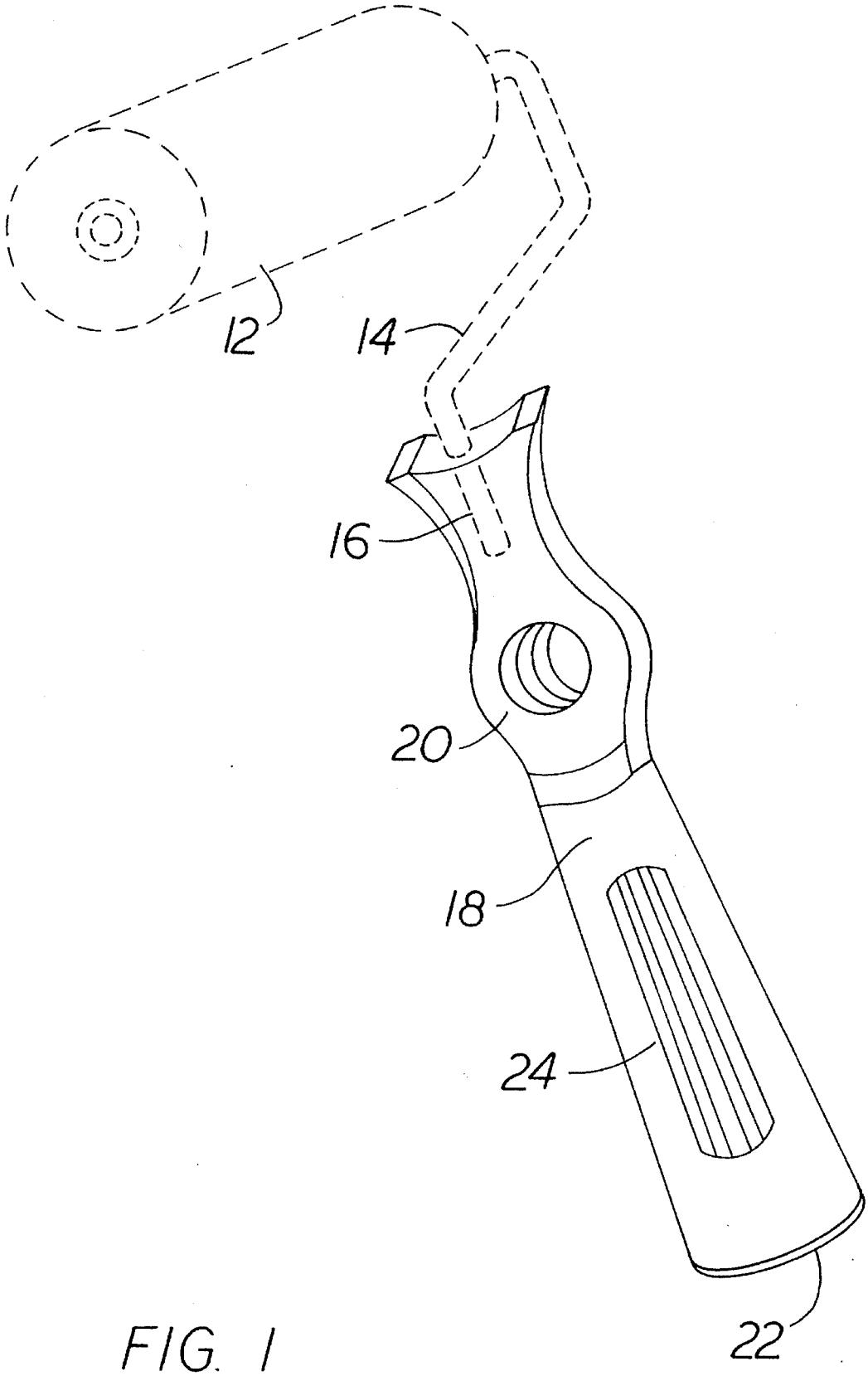
FIG. 1 shows a possible construction of a paint roller handle that contains a transverse hole.

List of Drawing Reference Numerals:

12 Schematic of a commonly used paint roller (prior art)
14 A metal rod (prior art) connecting the paint roller and the roller handle
16 One end of the handle in which the metal rod 14 is embedded
18 A paint roller handle
20 A transverse hole to accommodate a telescopic rod
22 A vertical hole at the opposite end of the handle to accommodate a telescopic rod
24 The gripping portion of a roller handle
26 A metal rod similar to 14 (prior art) connecting the paint roller and the roller handle
28 One end of the handle in which the metal rod 26 is embedded
30 The first handle segment that contains at least one transverse hole
32 A transverse hole to accommodate a telescopic rod
34 A vertical hole at the opposite end of the second handle segment
36 The second segment of a handle
38 A vertical hole (threaded or un-threaded) at the end of the first handle segment to accommodate one end of the second handle segment or a telescopic rod
40 One end (threaded) of the second handle segment to fit into 38
42 One end (tapered, graded, grooved, etc) of the second handle segment to snap-fit with 38
44 A paint roller retaining frame (prior art)
46 A paint roller spray shield (prior art)
48 An adjustable pivot (prior art) that connects the roller to the handle
50 A paint roller handle
52 A transverse hole to accommodate a telescopic rod
54 The gripping portion of a handle
56 A vertical hole at the opposite end of a handle to accommodate a telescopic rod
58 The first handle segment that contains at least one transverse hole
60 The second segment of the handle
62 A transverse hole to accommodate a telescopic rod
64 A vertical hole (threaded or un-threaded) at the end of the first handle segment to accommodate one end of the second handle segment or a telescopic rod
66 One end (threaded in this diagram, but can be tapered or otherwise properly shaped) of the second handle segment to fit into 64
68 A vertical hole at the opposite end of the second handle segment
222 A wire coil female thread forming a transverse hole to accept the male thread 232 of a handle 234 or telescopic rod
224 A wire shaft to support the roller frame
226 The end of the transverse female thread 222, which may be extended, starting from 228, to include a vertical female thread
228 The point that continues from the end 226 of the transverse thread; or the point where the transverse thread and the vertical thread are connected
230 A vertical wire coil female thread
232 The male thread of a handle (or a telescopic rod) to be inserted into and be tightened by the female thread, either transverse 222 or vertical 230
234 Part of a handle that contains a male thread 232

DETAILED DESCRIPTION OF PREFERRED EMBODIMENTS

Preferred embodiments of the present invention can be best illustrated by referring to the following examples with attendant figures.

EXAMPLE 1

Shown in FIG. 1 is an example of un-shielded paint rollers, in which the roller body 12 (prior art) mounted on a supporting frame is connected to or integral with a properly bent metal rod or shaft 14 (prior art) partially embedded at one end 16 of a handle 18. The handle 18 has a transverse hole 20 that can accommodate a telescopic or extension rod (not shown) to facilitate horizontal roll-painting on a high spot. The hole is preferably inclined at an angle of 90 degrees with respect to the handle, but may be at any angle of between approximately 30 and 90 degrees. Although the handle may have two or more than two transverse holes, one transverse hole is considered adequate for practical purposes. The gripping portion 24 of the handle is preferably properly shaped or textured so that the handle can be comfortably gripped by a hand. The other end of the handle preferably has a end hole 22, extending longitudinally within handle 18 to receive the extension rod for vertical rolling. Both transverse and vertical (end) holes may be threaded or un-threaded but properly textured to permit fitting an extension rod tightly or snugly.

Alternatively, the end of the shaft, instead of being embedded or permanently attached to the top end of the handle, can be removably inserted into a top vertical hole near 16 and be firmly fastened by using one or two screws or bolts (not shown) or other fastening means. When transverse rolling is desired, the shaft can be removed and inserted into a transverse hole (not shown) and be fastened by a similar means. In this way, the shaft will be inclined with the handle at an angle that is approximately zero or 90 degrees, or any degree value in between, depending upon the orientations of the two holes.

EXAMPLE 2

Figure 2A:
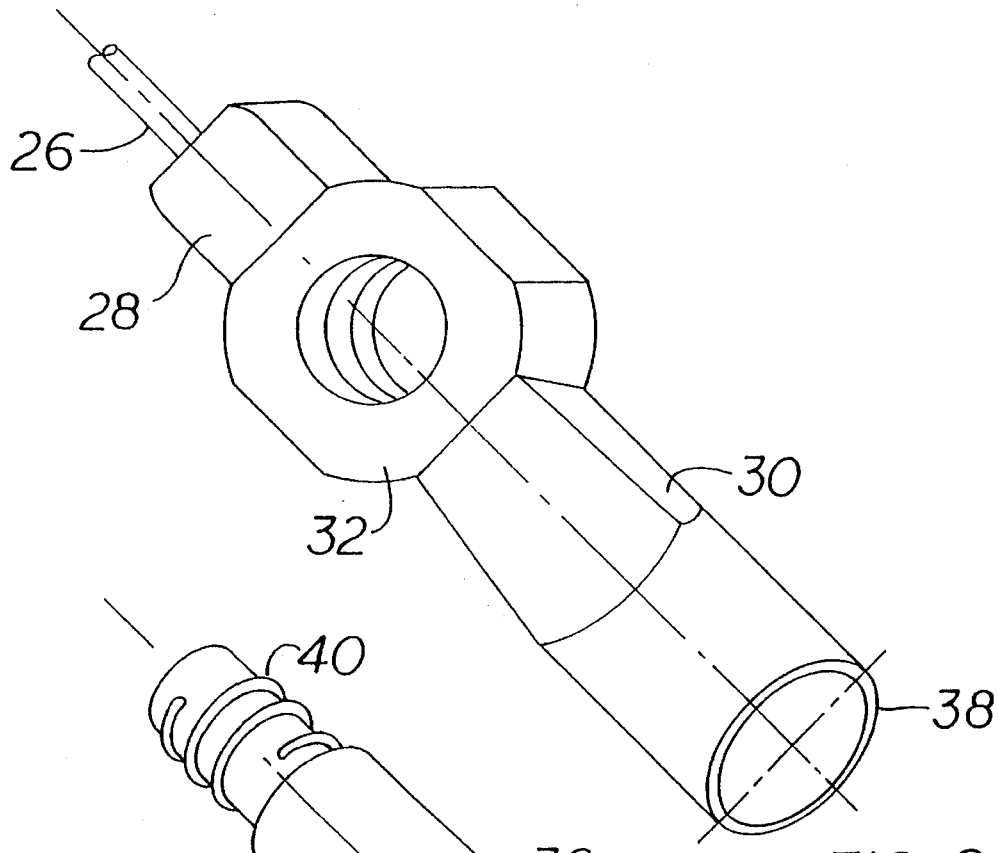
FIG. 2*a* shows a paint roller handle that has two segments; the first segment has one transverse hole and one vertical hole while the second segment has one vertical hole.
Figure 2B:
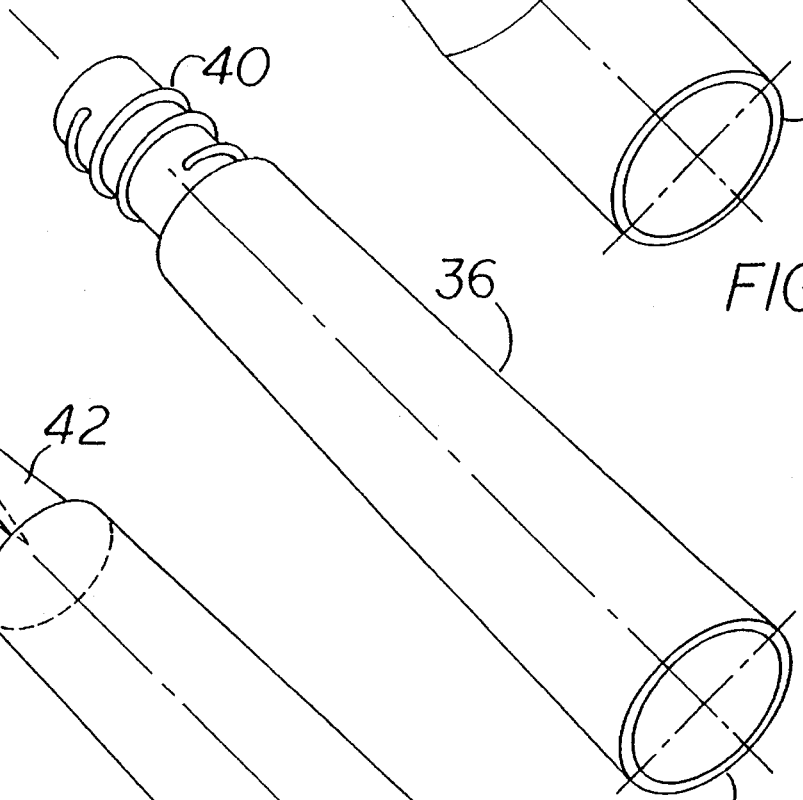
FIG. 2*b* shows a possible design of the second handle segment that has one end threaded to fit in a threaded transverse hole.
Figure 2C:
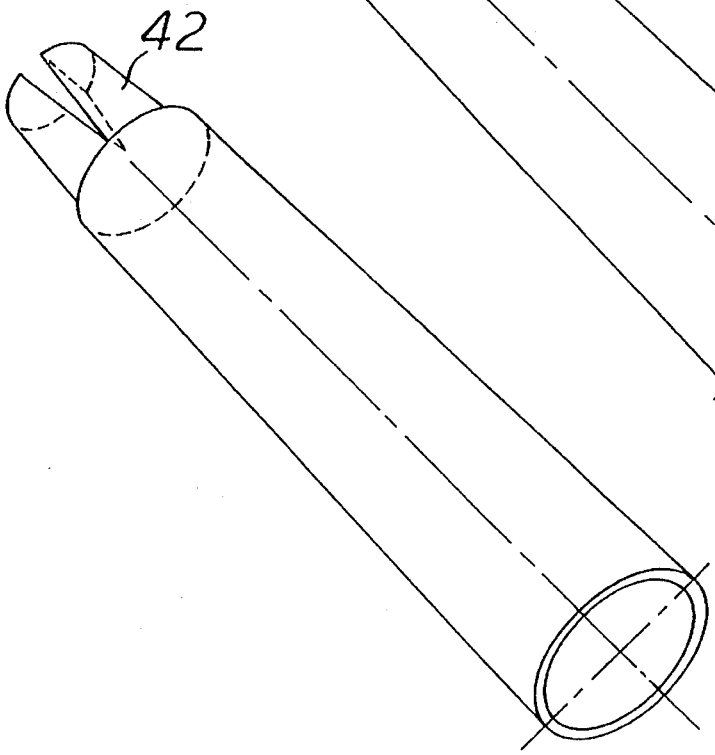
FIG. 2*c* Shows a possible design of the second handle segment that has an un-threaded, but tapered end to fit in an un-threaded transverse hole.

The roller handle, as described in Example 1, will require a separate handle or a telescopic rod to make it practical to effect horizontal rolling. One alternative design for a roller handle is to divide it into two segments which are detachable from each other, as shown in FIG. 2. The metal rod or shaft 26 (prior art) is connected to one end 28 of the first handle segment 30. The two handle segments, 30 and 36, can be separated from each other simply by un-screwing the threaded male portion 40 in 36 from the threaded hole 38 in 30. Alternatively, the threaded portion may be replaced with an un-threaded tip 42 to snap fit an un-threaded hole 38. The threaded portion 40 or its un-threaded counterpart 42 can be fitted into the transverse hole 32. Thus, these designs permit the handle to be used in two positions for horizontal and vertical rolling. Just like in Example 1, the opposite end 34 of the handle should preferably have a hole of the same geometry as the transverse hole 32 so that an extension rod can be inserted into 32 or 34 interchangeably.

EXAMPLE 3

Figure 3:
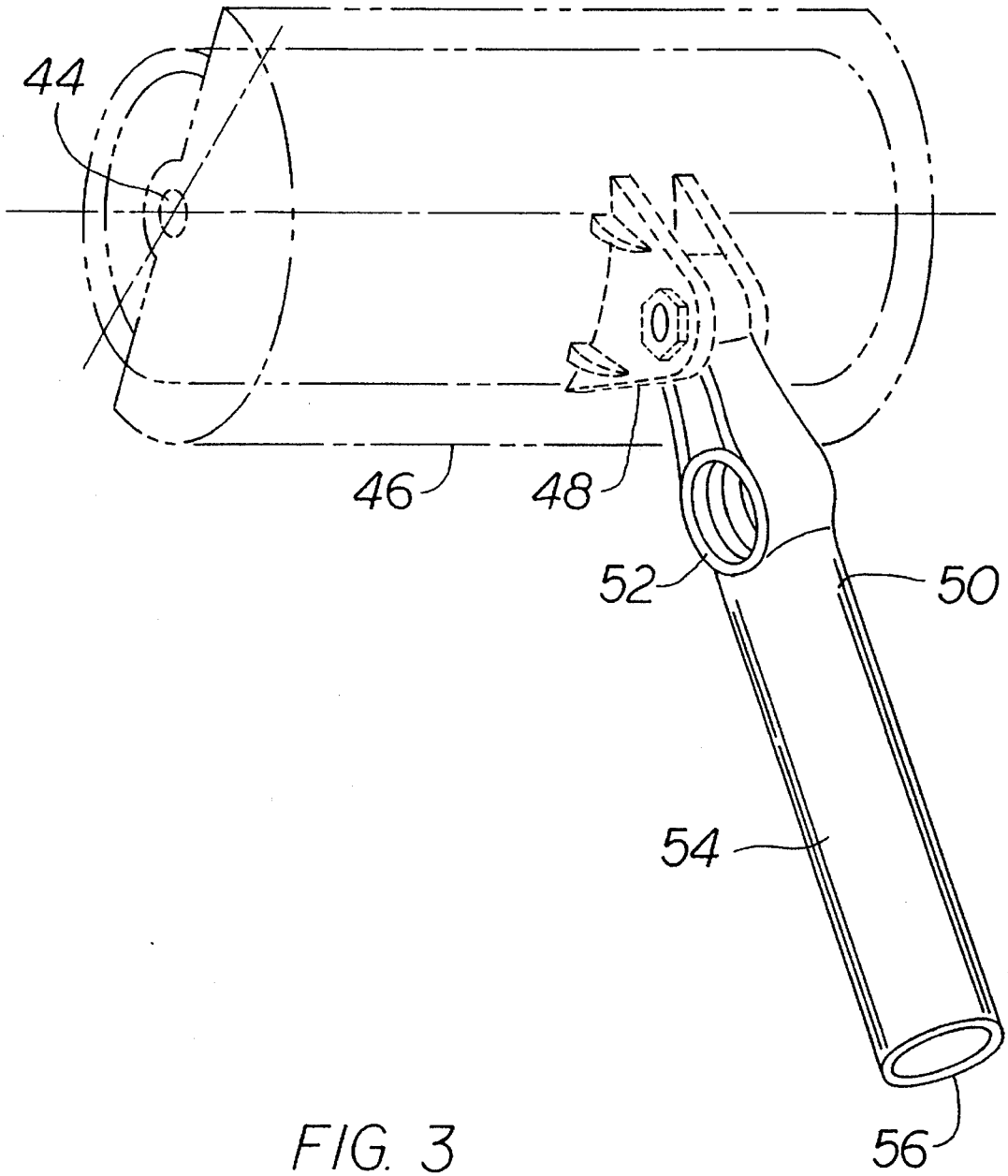
FIG. 3 shows a handle for an un-shielded paint roller; the handle having a transverse hole and a vertical hole.

An example of shielded paint roller may be found in U.S. Pat. No. 3,825,970. FIG. 3 shows a similar paint roller retaining frame 44 (prior art) having a spray shield 46 (prior art) which is connected to a handle through an adjustable pivot 48 (prior art). The present invention provides a new handle construction 50 that contains a transverse hole 52, a gripping portion 54 and a vertical hole 56 at the end. Again, both the transverse 52 and vertical 56 holes can be threaded or un-threaded, depending on the design of the extension rod.

EXAMPLE 4

Figure 4:
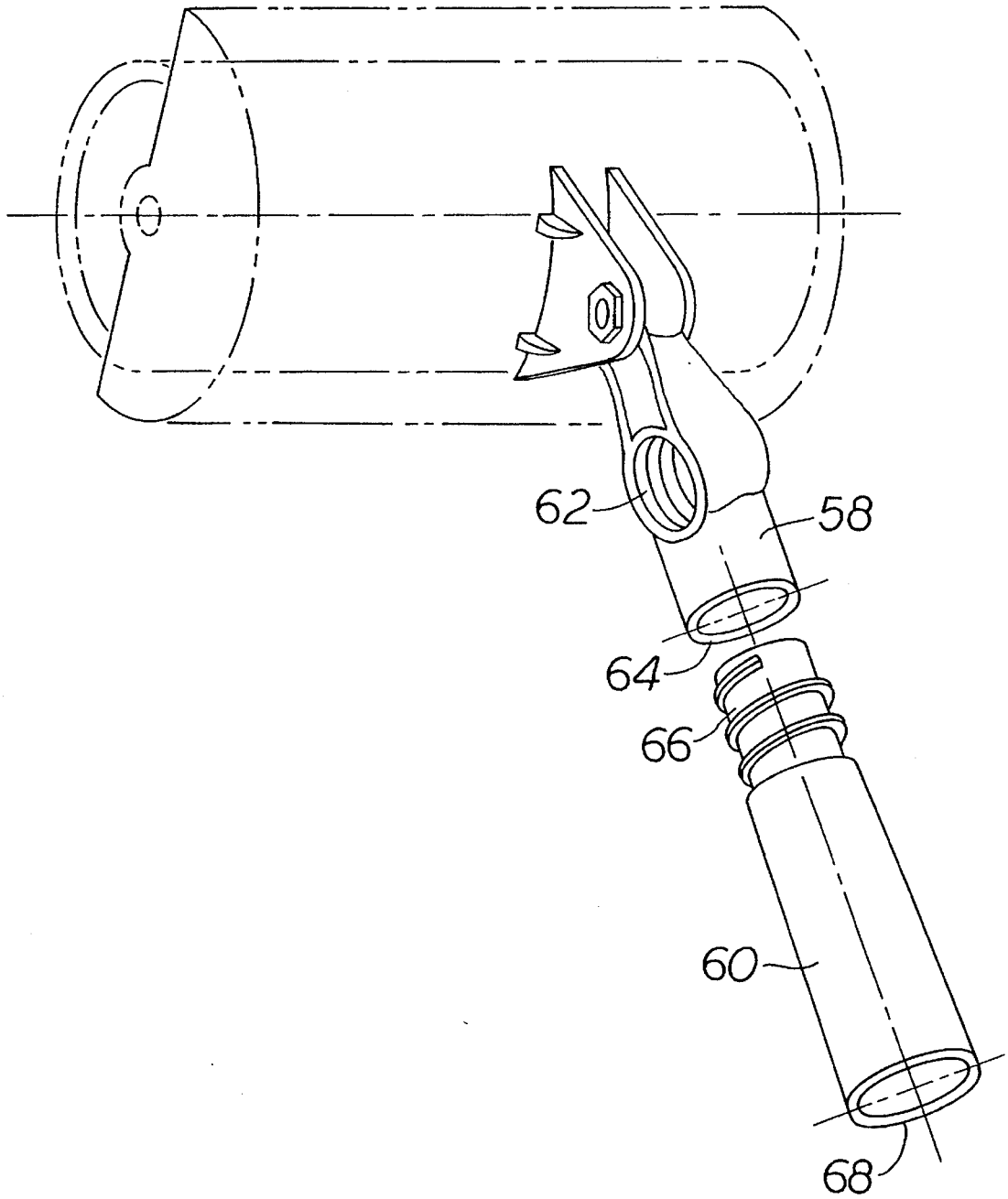
FIG. 4 shows another paint roller handle that has two segments; the first segment has one transverse hole and one vertical hole while the second segment has one vertical hole.

FIG. 4 shows another example of a two-segment roller handle. The first segment 58 contains a transverse hole 62 and a vertical hole 64 to accommodate one end 66 of the second handle segment 60 or an extension rod. The opposite end 68 of the second segment 60 preferably has a vertical hole to accept an extension rod. The three holes 62, 64 and 68 are preferably threaded to provide tighter fitting, although other types of connection such as snap fitting described earlier in Example 2 may be utilized.

It may be noted that the transverse holes in the handles as specified in the above examples are not necessarily inclined at an angle of 90° with respect to the handle length direction. The angle can vary between approximately 10° and 90°, preferably between 45° and 90°, and be best at approximately 90°.

EXAMPLE 5

Figure 5:
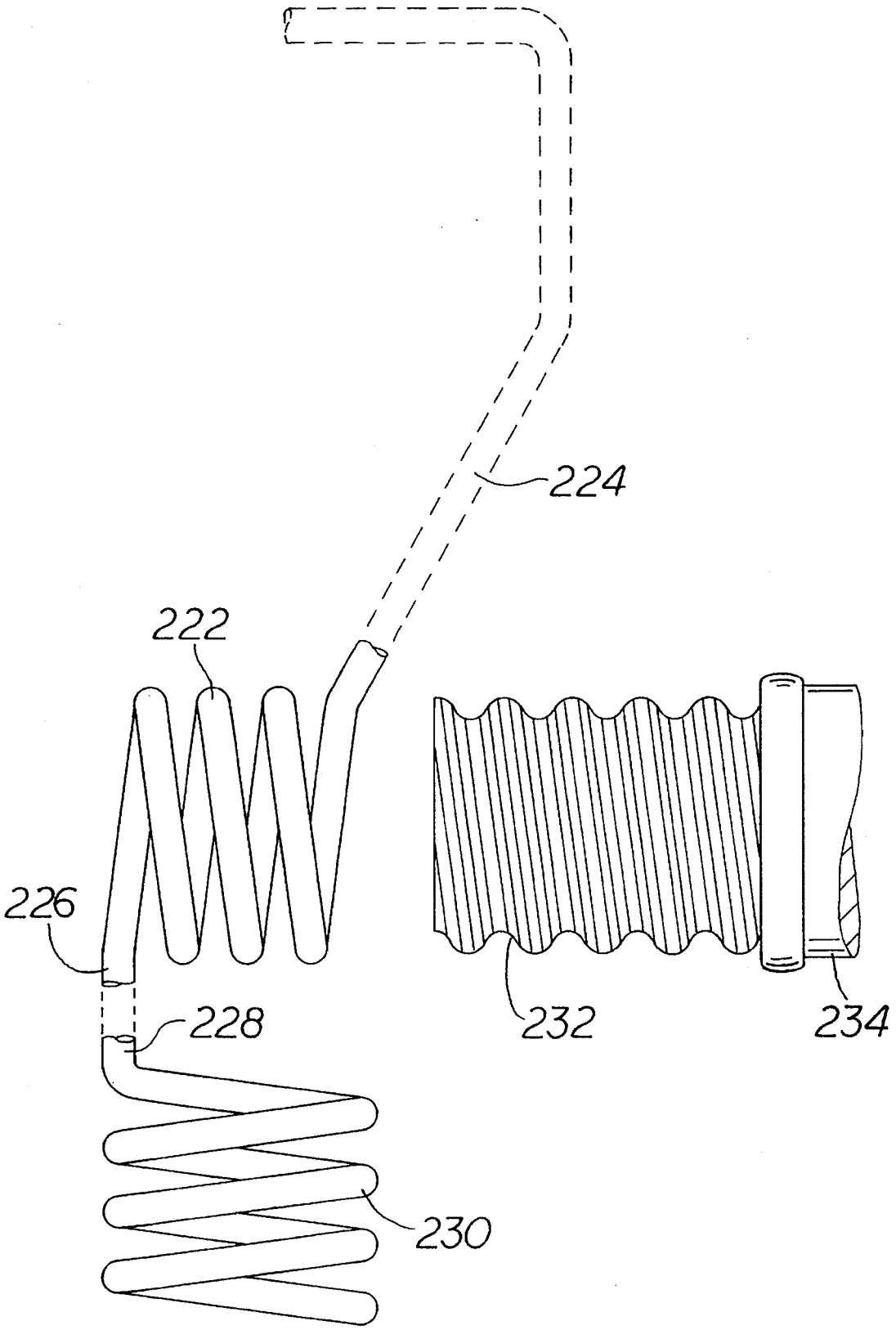
FIG. 5 shows a paint roller-frame combination wherein one end of the shaft wire contains a wire coil female thread forming a tansverse hole to accept a handle or telescopic rod. This transverse female thread may be further extended to include a vertical female thread.

Another simple variation of Example 2 is a handle-shaft combination having, at the end of a wire shaft 224 (FIG. 5) being considered as the first handle segment, at least a wire coil female thread 222 forming a transverse hole to accommodate the male thread 232 of either a handle 234 (or second segment of a handle) or a telescopic rod to facilitate horizontal paint rolling on high overhead surfaces. This wire coil female thread may be either formed directly in the wire frame or be connected to the roller frame shaft by any joining or fastening means. This transverse coil thread may be further connected to, or extended to include, a vertical coil female thread 230 (with 226 and 228 representing the same point) to permit vertical rolling as well as horizontal rolling.

The above five examples serve only to illustrate the preferred embodiments of the present invention. While the description of these examples contains many specificities, the reader should not construe these as limitations on the scope of the invention, but merely as exemplifications of preferred embodiments thereof. Those skilled in the art will envision many other possible variations are within its scope. For instance, in each discussed case, the roller handle, or the second segment of a two-segment handle, can be made sufficiently long so that the handle itself serves as a telescopic rod that, if so desired, can be connected to another extension rod. Further, there are many other mechanisms with which one can lock, catch, fasten, or otherwise tightly or snugly connect different segments of a roller handle together. A paint roller handle containing any such mechanism should be considered as a simple variation of the roller handle as specified in the presently stated preferred embodiments. The above five examples also demonstrate the design simplicity and flexibility of the roller handle configuration and, therefore, the ease with which one can manufacture these handles. These handles are preferably made out of plastic, metallic, wood-based materials or a combination thereof. The main body of a handle is preferably made of plastics by using any simple or fast process such as casting, resin transfer molding and injection molding. The parts in a pivot or other tightening mechanism such as bolts, pins, nuts, springs and balls are preferably made of metals such as steel. A paint roller containing any handle as disclosed in the present invention can be used to effectively paint horizontally or along many other directions which can not be accomplished by using a prior-art roller.

We claim:

1. A paint roller handle in combination with a paint roller having an axis of rotation, said roller handle having an elongated body, a first end connected to said paint roller, and a second end; said elongated body and said axis of rotation being orthogonal; first means formed in said elongated body intermediate said ends for releasably securing a longitudinal extension member to said elongated body in transverse relation thereto and second means formed in said elongated body at said second end transverse to said first means for releasably securing said longitudinal extension member to said elongated body in coaxial relation thereto.

2. A paint roller handle as defined in claim 1 wherein said first securing means comprises a transverse hole defined in said elongated body along an axis orthogonal to the longitudinal axis thereof, to accommodate a said longitudinal extension member in parallel relation to the axis of rotation of the paint roller.

3. A paint roller handle as defined in claim 2 wherein the elongated body further comprises first and second handle segments with said transverse hole formed in the first handle segment and said second securing means formed in the second handle segment with said second handle segment including an end portion which is adapted to fit selectively into said transverse hole and an end portion of said first handle segment.

4. A paint roller handle as defined in claim 1 wherein said first means comprises a wire coil female thread that constitutes a transverse hole to accommodate a male on said longitudinal extension member to facilitate horizontal paint rolling.

5. A paint roller handle as defined in claim 1 wherein said elongated body comprises a coiled wire defining said second securing means therein as an internal thread for engagement with a threaded end of said longitudinal extension member and defining said first securing means as a continuous section of said coiled wire formed parallel to said axis of rotation and defining a second thread for engagement with said threaded end.

* * * * *